US006109763A

United States Patent [19]

Ohta et al.

[11] Patent Number: 6,109,763

[45] Date of Patent: Aug. 29, 2000

[54] EMERGENCY FLASHLIGHT

[75] Inventors: Masuo Ohta, Moriguchi; Kinya Kawanobe, Iruma, both of Japan

[73] Assignee: Matsushita Electric Industrial Co., Ltd., Osaka-Fu, Japan

[21] Appl. No.: 09/148,570

[22] Filed: Sep. 4, 1998

[30] Foreign Application Priority Data

Sep. 30, 1997 [JP] Japan ..... 9-266078

[51] Int. Cl.[7] ..... F21L 4/04

[52] U.S. Cl. ..... 362/205; 362/124; 362/394; 362/808

[58] Field of Search ..... 362/124, 153.1, 362/187, 188, 189, 198, 205, 208, 288, 394, 395, 808

[56] References Cited

U.S. PATENT DOCUMENTS

| | | | |
|---|---|---|---|
| 2,581,129 | 1/1952 | Muldoon | 362/198 |
| 4,298,915 | 11/1981 | Goldfarb et al. | 362/124 |
| 4,364,104 | 12/1982 | Holahan et al. | 362/208 |
| 4,984,139 | 1/1991 | Goggia | 362/153.1 |
| 5,280,416 | 1/1994 | Hartley et al. | 362/198 |
| 5,285,359 | 2/1994 | Czipri | 362/288 |
| 5,434,761 | 7/1995 | Lesnick et al. | 362/189 |
| 5,558,430 | 9/1996 | Booty, Jr. | 362/205 |

FOREIGN PATENT DOCUMENTS 982103 of 0000 Japan .

*Primary Examiner*—Alan Cariaso
*Attorney, Agent, or Firm*—Price, Gess & Ubell

[57] ABSTRACT

Light section 1 comprises a body case 8 accommodating batteries 5 and a lens cap 7 containing a light bulb 4 and detachably mounted at the bottom edge opening of the body case 8. Outer periphery of light section 1 is covered by an outer cylindrical section 2 provided with a switching operation projection 10*a* and a stopper spring 12 such as to allow free relative sliding movements. The light section 1 and the outer cylindrical section 2 are stored in the hollow space of a decorative section 3 which is fitted with the outer cylindrical section 2. When the decorative section 3 is lifted from the state of being mounted on an installation surface 11, the outer cylindrical section 2 rises. Concurrently, an illumination circuit for the light bulb 4 is closed by a lead spring 9 being inwardly pushed by the switching operation projection 10*a*. The stopper spring 12 comes to engage with a descent stopper position 8*c* of body case 8, by which the light section 1 is kept in a state with the lens cap 7 projected from the bottom edge of the decorative section 3.

9 Claims, 4 Drawing Sheets

EMERGENCY FLASHLIGHT

BACKGROUND OF THE INVENTION

1. Technical Field

The present invention relates to an emergency flashlight which is decorative when kept on any stand, and is structured such that it contains a battery powered light and illuminates by being lifted from the stand.

2. Description of Related Art

It is useful to have battery powered flashlights ready for immediate use in the event of an emergency such as a power failure or disaster. Various emergency flashlights have thus been developed. One example of such emergency flashlight is attached to a wall-affixed holder which turns on a light by taking the flashlight out of the holder. In another example, the flashlight is maintained in a holder which indicates its position by blinking in the event of a nighttime power failure.

It is necessary to attach maintenance tools such as a holder for the flashlight to the wall surface to hold and maintain a flashlight available on a wall, but the positioning of emergency flashlights are limited under recent housing situations which use a lot of concrete or new construction materials. It is possible to place a general flashlight rather than a specially structured emergency flashlight in a room and use it as an emergency flashlight, but a utilitarian flashlight placed in a readily visible location in a room is not esthetically desirable. Therefore, flashlights which are decorative in appearance by having decorative covers will help relieve the feeling of being out of place when they are kept in a room. However, such decorative covers may make the light difficult to switch on and off and may reduce its function to act as a source of lighting.

BRIEF SUMMARY OF THE INVENTION

An object of this invention is to provide an emergency flashlight which is decorative in the regular state as well as conveniently used as a flashlight.

In order to achieve the above object, the emergency flashlight according to the present invention comprises a cylindrical light section which is equipped at a bottom edge thereof with a lens cap containing an electric light and stores batteries at an upper position of the lens cap; an outer cylindrical section holding and encasing the light section freely movable along an axial direction between an accommodated position and a lens cap projecting position; a switch means which turns off the electric connection between the light bulb and the batteries when the light section is accommodated in the outer cylindrical section and turns on the electrical connection when the lens cap of the light section is located in the lens cap projecting position projecting downwards from the outer cylindrical section; a unidirectional stop means which stops the light section at the lens cap projecting position and imparts a large resistance against only the movement from this position to the accommodated position; and a decorative section which is fixed to the outer cylindrical section and covers the outer cylindrical section and the light section; wherein when the emergency flashlight is lifted from an installation surface, the light section descends into the lens cap projecting position, and when the lifted emergency flashlight is mounted on the installation surface and a large downward force which overcomes resistance from the unidirectional stop means is imparted, the light section moves to the accommodated position, and when the emergency flashlight is directed to any given direction, the light section is kept in the lens cap projecting position by means of the large resistance from the unidirectional stop means.

With the above described structure, there is no feeling of being out of place for the emergency flashlight placed at a readily visible location in a room, since only the decorative section is exhibited when the flashlight is kept mounted on any installation surface and in a maintained state. When the decorative section is lifted from the maintained state, the outer cylindrical section is lifted along with the decorative section and the light section held freely movable by the outer cylindrical section descends in relation to the outer cylindrical section under its own weight making the lens cap positioned in the projecting position, by which movement a switch means illuminates the electric light. Also, the unidirectional stoppage means systematically stops the light section at where the lens cap is projecting from the bottom edge of the decorative section. Accordingly, the lifted decorative section can be oriented in any direction while being used as a flashlight.

The stoppage in the light section by the unidirectional stop means is removed and the light bulb is extinguished and returns to the original regular state from the state of the lens cap projecting with the light bulb illuminated when the lens cap is mounted with direct contact upon the surface of the installation surface and sufficient force to overcome the resistance of the unidirectional stop means stopping the light section is applied.

In the structure described above, a compression spring may be set between the upper surface of the top of the light section and the lower surface of the top of the decorative section so that when the emergency flashlight is lifted from the installation surface, the light section descends into the lens cap projecting position under its own weight and the urging force of the compression spring, by which the movement of the light section is ensured by adding the urging force of the spring to the weight of the light section, even in cases when the resistance of the sliding section or weight balance is improper due to factors such as flashlight assembly errors.

BRIEF DESCRIPTIONS OF THE DRAWINGS

DETAILED DESCRIPTION OF PREFERRED EMBODIMENTS

A preferred embodiment of the present invention will be hereinafter described with reference to the accompanying drawings for better understanding of the invention.

Figure 1:
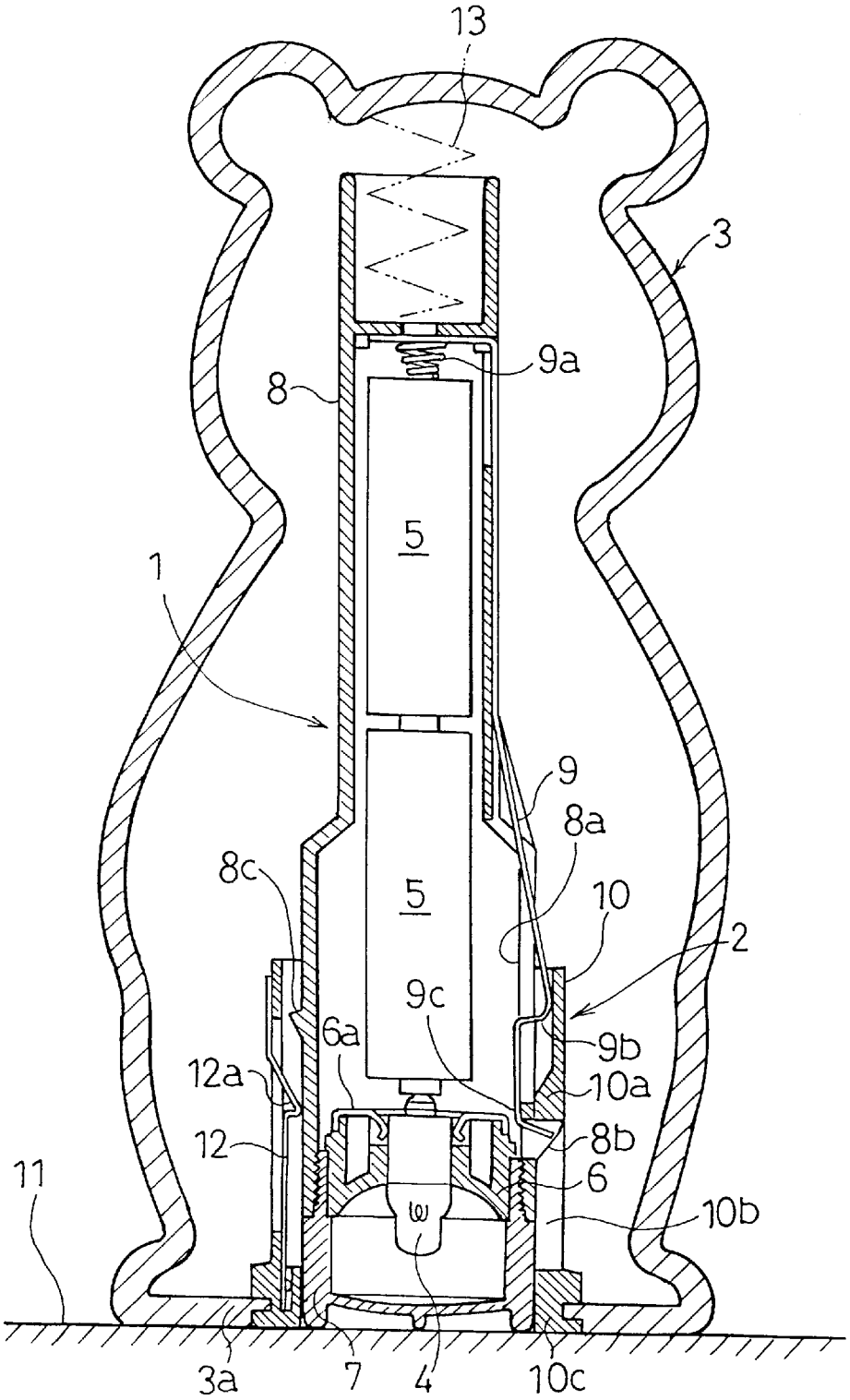
FIG. 1 is a cross sectional view showing the configuration of an emergency flashlight in a regularly maintained state according to one embodiment of the present invention.
Figure 2:
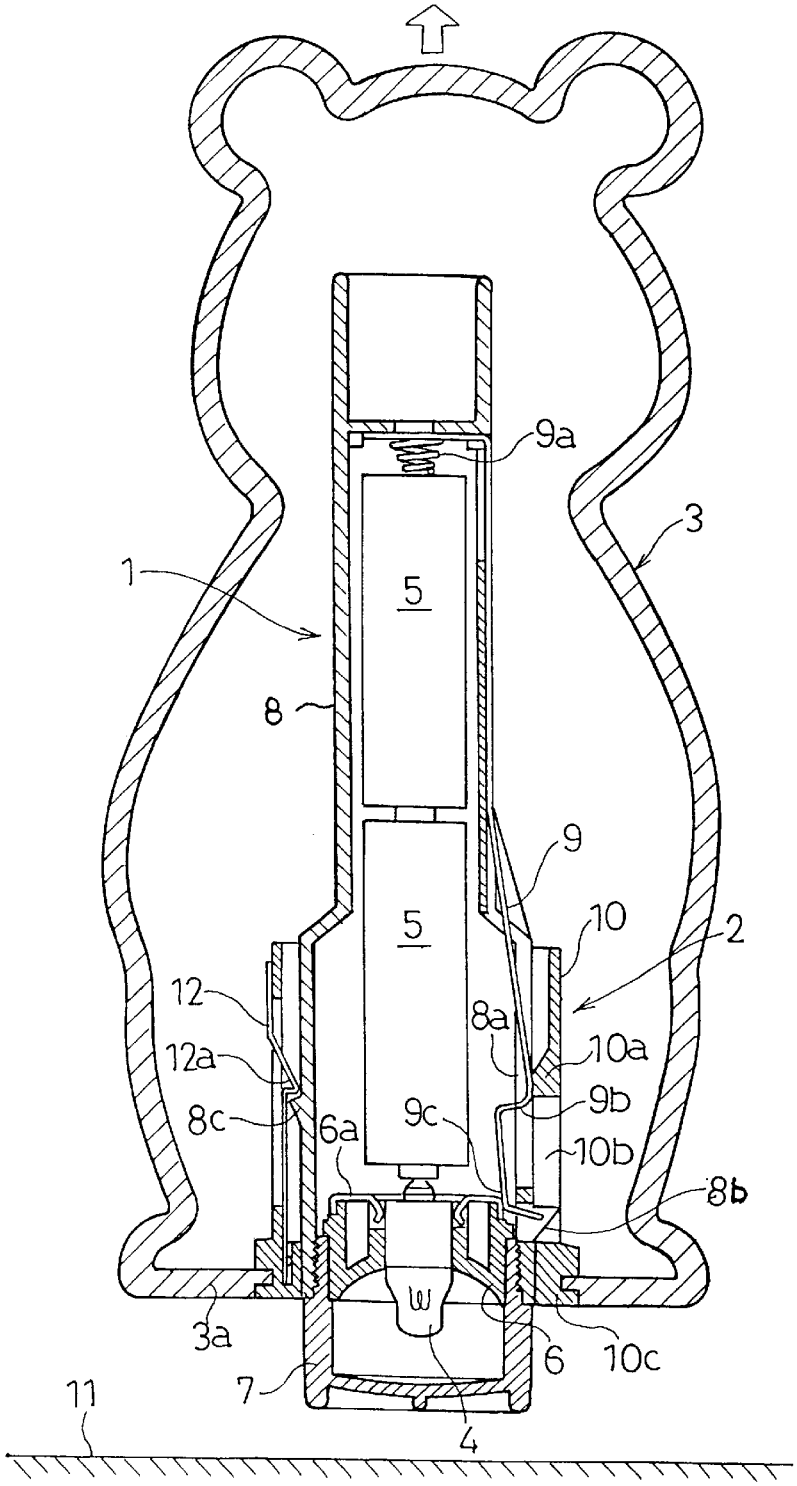
FIG. 2 is a cross sectional view showing the configuration of the emergency flashlight in the state when it is lifted from the regularly maintained state.

FIGS. 1 and 2 are sectional views showing the composition of an emergency flashlight according to one embodiment of the present invention. FIG. 1 indicates the regular maintained state atop an installation surface 11 such as a desk or shelf, and FIG. 2 indicates the lifted state from the installation surface 11. The emergency flashlight is comprised of a light section 1 which stores batteries 5 and a light bulb 4, an outer cylindrical section 2 which holds the light section 1 such as to allow free movements along the axial direction, and a decorative section 3 which is fit with the outer cylindrical section 2 at the bottom and contains the light section 1 and outer cylindrical section 2 within its hollow space.

In the light section 1, a lens cap 7 coupled to a light bulb socket 6, which supports a light bulb 4 such as to accommodate an illuminating portion of the light bulb 4 within its transparent tube, is detachably connected by screw means at the opening of the lower end of a body case 8, which is formed in the shape of a cylinder with a top. The lens cap 7 is removed from the body case 8 for allowing batteries 5, 5 to be inserted in series through the opening edge of the body case 8. When the lens cap 7 is screwed on the body case 8, the electrode at the center of the base of light bulb 4 is brought into contact with the electrode of one side of one battery 5. At the top of the body case 8 is a coil spring 9*a* which is one end of a lead spring (switch means) 9 formed into a coil shape. When the batteries 5 are inserted into the body case 8 and the lens cap 7 is screwed on, the coil spring 9*a* is compressed and comes into contact with the electrode of the other end of other battery 5. The lead spring 9 with one end formed into coil shaped coil spring 9*a* as described above is fitted and held in a groove along the external surface of the body case 8 to a position near the light bulb socket 6. Along its way, a switching operation point 9*b* is formed in a swelling or extended manner such that it is externally exposed from a groove-shaped opening 8*a* of the body case 8. When this switching operation point 9*b* is pushed inwardly, a switch contact point 9*c* at the other end of the lead spring 9 contacts the lead plate 6*a* of the light bulb socket 6, in which the exterior electrode of the base of light bulb 4 is fitted, thereby illuminating the light bulb 4 by electricity from the batteries 5, 5.

The outer cylindrical section 2 holds the light section 1 freely movable by a cylinder-shaped outer cylinder 10, in which a switching operation projection 10*a* is formed at a position opposing the lead spring 9 in the light section 1, and below that, an aperture window 10*b* is formed which freely fits an ascent stopper projection 8*b* projecting externally from the body case 8. Also, a stopper spring 12 is installed in a position so as to correspond to a descent stopper projection 8*c* formed in the body case 8.

Figure 3B:
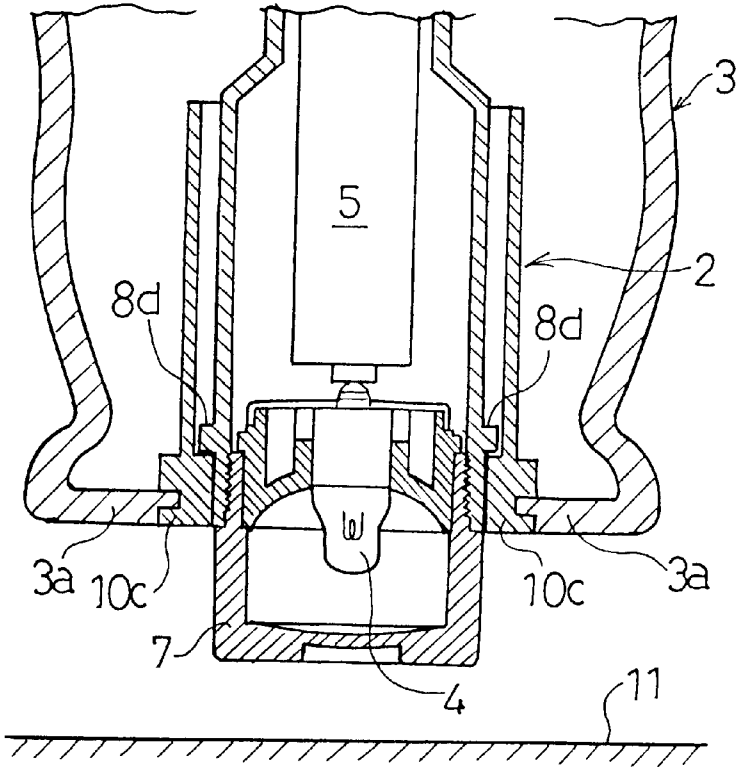
FIGS. 3A and 3B are sectional views along a direction orthogonal to the sectional direction of FIGS. 1 and 2, respectively showing the regularly maintained state and the lifted state.
Figure 3A:
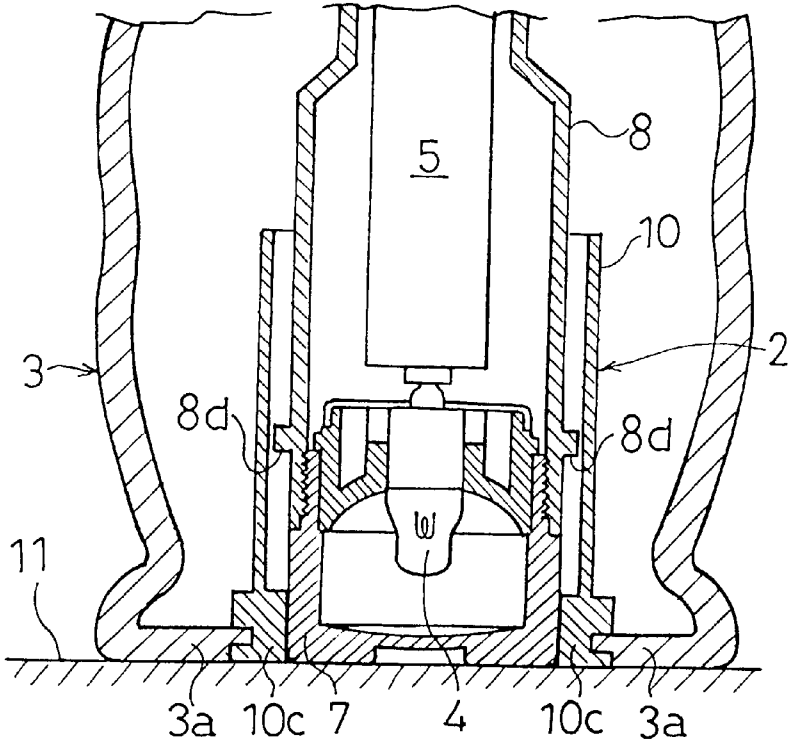

FIGS. 3A and 3B are sectional views at right angles to the sectional direction of FIGS. 1 and 2, showing descent position control projections 8*d*, 8*d* formed on both external sides of the body case 8. These descent position control projections 8*d*, 8*d* restrict an upper limit of the sliding movement of the outer cylindrical section 2.

Figure 4:
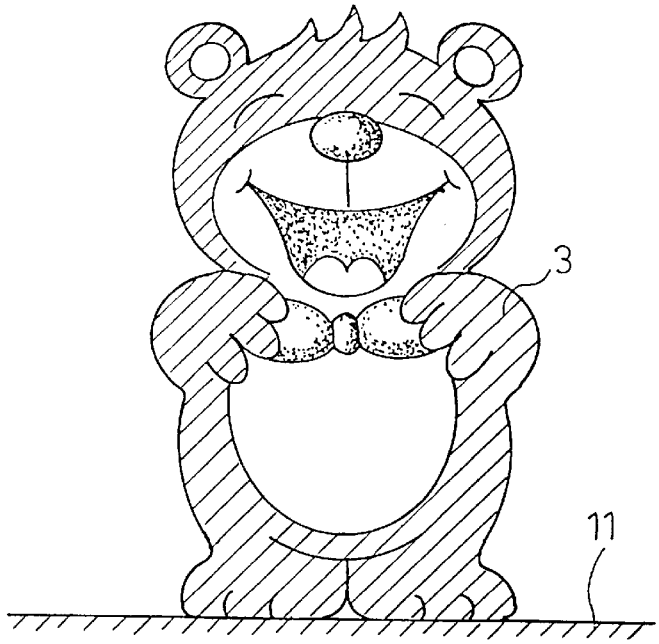
FIG. 4 is a front exterior view showing an example of the decorative section configuration.

The decorative section 3 has an external appearance, for example, of a comic character as shown in FIG. 4, and is formed by slash molding as a hollow structure. Any other external appearance may be adopted such as personage, animal, commercial character, or the like. The light section 1 and outer cylindrical section 2 are involved in the hollow space of the decorative section 3, and the periphery of the opening formed on the bottom 3*a* of the decorative section 3 is fitted and fixed with a fitting section 10*c* formed in the outer cylinder 10 so that the decorative section 3 only is seen when the emergency flashlight is placed on the stand 11.

When the decorative section 3 of the emergency flashlight constructed as above is lifted from the top of the stand 11 where it is regularly kept, as shown in FIG. 1, the outer cylindrical section 2 fixed in the decorative section 3 is concurrently lifted, but the light section 1 tries to remain in position under its own weight. The outer cylindrical section 2 thus ascends along the outer perimeter of the light section 1, and this upward movement of the outer cylindrical section 2 causes the light section 1 to be lifted up together with the outer cylinder 10 when the upper edge of the fitting section 10*c* of the outer cylinder 10 comes to contact with the descent position control projections 8*d* formed in the body case 8 of the light section 1 as shown in FIG. 3B which provides a storage compartment for the batteries.

When the outer cylindrical section 2 ascends, as shown in FIG. 2, the switching operation projection 10*a* formed in the outer cylinder 10 contacts the swollen part of the switching operation point 9*b* of the lead spring 9 on its slanted surface toward its ascending direction and pushes the switching operation point 9*b* inwardly along the incline, by which the switch contact point 9*c* at the bottom edge of the lead spring 9 is contacted with the lead plate 6*a* of the light bulb socket 6, and the illumination circuit of the light bulb 4 is closed, thereby illuminating the light bulb 4.

At this time, the descent stopper projection 8c formed in the body case 8 functions to stop the light section 1 at the descent position. When the light section 1 moves downwards in relation to the outer cylindrical section 2, the descent stopper projection 8*c* contacts a projecting portion or detent 12*a* of the stopper spring 12, which is mounted in the outer cylinder 10, pushing the projecting portion 12*a* outwardly with its slanted surface. After the descent stopper projection 8*c* exceeds the projecting portion 12*a*, the descent stopper projection 8*c* and the projecting portion 12*a* of the stopper spring 12 are coupled on their respective level parts as shown in FIG. 2. The emergency flashlight can be lifted from the installation surface 11 and used as a flashlight at any angle because this stoppage system keeps the light section 1 illuminated and the lens cap 7 coming from the decorative section 3 is projected.

When the emergency flashlight is placed on the installation surface 11, the engagement of the stopper spring 12 and the descent stopper projection 8*c* is maintained as long as a load is not exerted, keeping the lens cap 7 projected and the light bulb 4 illuminated. This state becomes like a lantern with a dim light illuminating the surroundings and so can be used as a lamp giving a feeling of safety during a power failure or such. When a little downward pressure is applied from this state, or a little downward pressure is applied when the emergency flashlight is mounted on the installation surface 1, the downward pressure added to the weights of the decorative section 3 and the outer cylindrical section 2 releases the engagement between stopper spring 12 and the decent stopper protection 8*c*. The decorative section 3 and outer cylindrical section 2 are thus allowed to descend to the surface of the stand 11, by which the switching operation projection 10*a* pressing against the switching operation point 9*b* of the lead spring 9 is released. Consequently, the switch contact point 9*c* is disconnected from the lead plate 6*a*, thereby opening the illumination circuit of the light bulb 4 and extinguishing the light bulb 4, thus returning to the regular state shown in FIG. 1.

It may also be constructed such that just by placing the emergency flashlight with its light bulb 4 illuminated and the lens cap 7 protruded on the installation surface 11, the outer cylindrical section 2 and decorative section 3 descend under their own weight, thereby extinguishing the light bulb 4. This can be accomplished by adjusting the weight of the outer cylindrical section 2 and decorative section 3 and the engaged pressure between the stopper spring 12 and the descent stopper projection 8*c*.

Meanwhile, the position in the ascending direction of the light section 1, is restricted by the direct contact of the ascent stopper projection 8*b* facing out toward the body case 8 and the top edge of the aperture window 10*b* as shown in FIG. 1. This ascent position control of the light section 1 is provided so that the added pressure of screwing the lens cap 7 onto the body case 8 when batteries are exchanged or such will not allow the light section 1 to rise higher than the ascent position.

Additionally, a spring 13 may be provided as shown by the phantom line in FIG. 1 between the top surface of the body case 8 and the inside surface of the decorative section 3. This will help the light section 1 move smoothly to the lens cap projecting position, owing to the urging force of the spring 13 added to the weight of the light section 1. Since the light section 1 is stored with a slight gap from the outer cylindrical section 2, quite a lot of resistance is added to the movement of the light section 1 due to the sliding contact between the stopper spring 12 and the descent stopper projection 8*c*, and the sliding contact between the switching operation point 9*b* of the lead spring 9 and the switching operation projection 10*a*. Such urging force added by the spring 13 will overcome increased resistance and impart smooth mobility in case that the weight of the light section 1 is not sufficient to move smoothly due to processing or assembly errors or deterioration of component materials and such.

Figure 5:
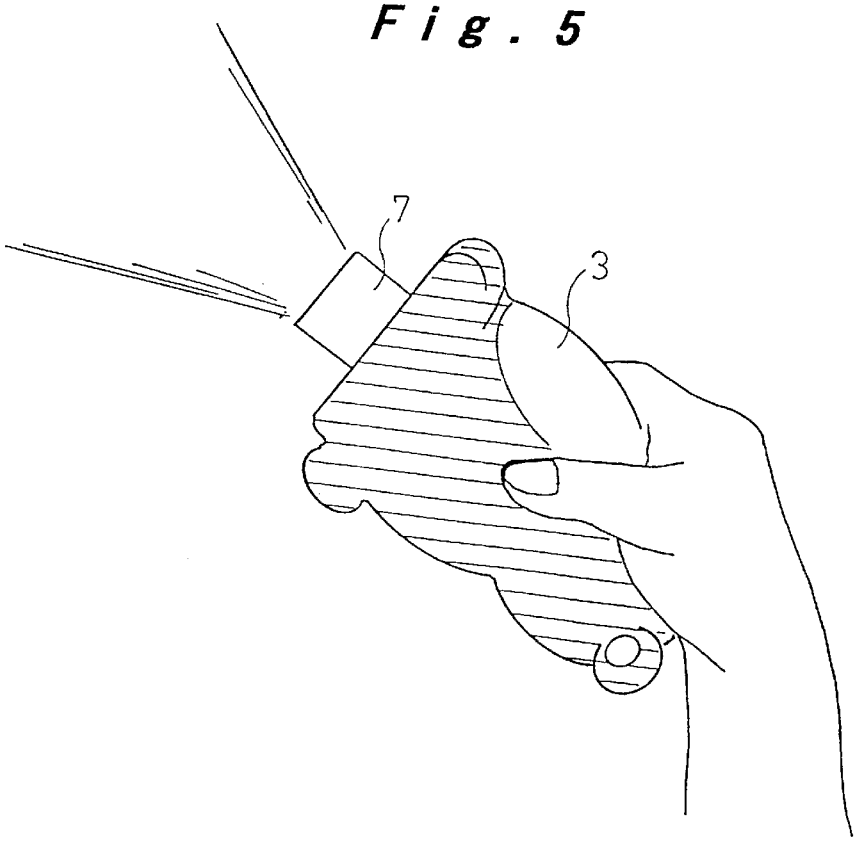
FIG. 5 is an inclined view of the lifted state from the regularly maintained state and being used as a flashlight.

The decorative section 3 may be formed to any hollow shape by splash molding and freely colored so that it will not seem out of place when it is placed in a visible location in a room as a decorative object. For example, if it is made in the form of a comic character which would delight a child as is shown in FIG. 4 and placed on any stand surface 11 in a room, it will look like the comic character itself. Yet this ornament is transformed into a flashlight when it is lifted since the lens cap 7 pops out of the bottom surface and illuminates, as shown in FIG. 5. In this way it becomes a decorative ornament which can be used as a flashlight depending on the occasion without a feeling of being out of place when it is maintained in a handy location in a room. It can also be used as an advertising object by forming it into a corporate or merchandise commercial character with a brand logo. Various products can be developed by mounting variously shaped decorative section 3 with the light section 1 and the outer cylindrical section 2 which are common interior components because the decorative section 3 can be manufactured in any shape by slash molding.

In the case of a simple shape, it is possible to construct such that the exterior of outer cylindrical section 2 is shaped into a decorative body, and the light section 1 is covered by the outer cylindrical section 2 formed in this decorative body.

As set forth above, the flashlight of the present invention illuminates upon being lifted automatically in the event of a power failure, disaster, or the like and it can be a decorative object kept in a visible location in a room, since it can be configured so that the flashlight function involved is inside the decorative body. Also, it sufficiently exhibits the function of a flashlight because the light section illuminates along with the lens cap part of the light section popping out from the decorative section when the decorative section is lifted from the stand surface.

While a preferred embodiment of the invention has been described using specific terms, such description is for illustrative purposes only, and it is to be understood that changes and variations may be made without departing from the spirit or scope of the following claims.

What is claimed is:

1. An emergency flashlight comprising:

a cylindrical light section which is equipped at a bottom edge thereof with a lens cap containing an electric light and stores batteries at an upper position of the lens cap;

an outer cylindrical section holding and encasing the light section freely movable along an axial direction between an accommodated position and a lens cap projecting position;

a switch means for turning off electric connection between the light bulb and the batteries when the light section is accommodated in the outer cylindrical section and for turning on the electrical connection when the lens cap of the light section is located in the lens cap projecting position projecting downwards from the outer cylindrical section;

a unidirectional stop means for stopping the light section at the lens cap projecting position and for imparting a large resistance against only the movement from this position to the accommodated position; and a decorative section which is fixed to the outer cylindrical section and covers the outer cylindrical section and the light section; wherein when the emergency flashlight is lifted from an installation surface, the light section descends into the lens cap projecting position, and when the lifted emergency flashlight is mounted on the installation surface and a large downward force which overcomes resistance from the unidirectional stop means is imparted, the light section moves to the accommodated position, and when the emergency flashlight is directed to any given direction, the light section is kept in the lens cap projecting position by means of the large resistance from the unidirectional stop means.

2. The emergency flashlight as claimed in claim 1, wherein the light section descends under its own weight into the lens cap projecting position when the emergency flashlight is lifted from the installation surface.

3. The emergency flashlight as claimed in claim 1 wherein a compression spring is set between an upper surface of the top of the light section and the lower surface of the top of the decorative section, and when the emergency flashlight is lifted from the installation surface, the light section descends into the lens cap projecting position under its own weight and an urging force of the compression spring.

4. An emergency flashlight comprising:

a light section member which is equipped at a bottom edge thereof with a lens cap containing an electric light member and stores batteries at an upper position above the lens cap;

an outer section member for encasing the light section member so that the light section member can be movable along an axial direction between a storage position and a light projecting position;

a switch unit operatively connected to the light section member which disconnects an electric connection between the light member and the batteries when the light section member is accommodated in the outer section member and turns on the electrical connection when the lens cap of the light section member is located in the light projecting position so that the lens cap projects outward from the outer section member;

a stop member mounted in the outer section member for stopping the light section member at the light projecting position and imparting a resistance against any movement from this light projecting position to the storage position; and an outer housing which is fixed to the outer section member and encompasses the outer section member and the light section member in the storage position; wherein when the emergency flashlight is lifted from a support surface, the light section member descends into the light projecting position and is activated, and when subsequently the emergency flashlight is placed on the support surface and a downward force overcomes the resistance from the stop member, the light section member moves to the storage position.

5. The emergency flashlight as claimed in claim 4, wherein the light section member descends under its own weight into the light projecting position when the emergency flashlight is lifted from the support surface.

6. The emergency flashlight as claim in claim 4 wherein a compression spring is mounted between an upper surface of a top of the light section member and an interior surface of a top of the outer housing, and when the emergency flashlight is lifted from the support surface, the light section member descends into the light projecting position as a result of its own weight and an urging force from the compression spring.

7. A combination decorative item for display and flashlight comprising:

a housing member having a decorative exterior surface and a hollow cavity;

an outer section holder member mounted in the cavity of the housing member;

a light projecting bulb movably mounted in the outer section holder member to extend outward from the outer section holder member and the housing member to project light and to extend within the outer section holder member and the housing member for storage;

a storage compartment in the cavity of the housing member for storing batteries to provide power to the light projecting bulb; and a switch member connecting the batteries to the light projecting bulb for activating the projection of light only when the light projecting bulb extends outward from the housing member and disconnects the batteries when the light projecting bulb is stored within the housing member, wherein the switch member includes a cantilevered spring with a cam follower section which contacts a cam member on the outer section holding member to activate the light projecting bulb.

8. The combination decorative item and flashlight of claim 7 wherein the housing member is configured in the shape of a toy animal.

9. The combination decorative item and flashlight of claim 7 further including a stop member mounted on the storage compartment and a spring mounted detent mounted on the outer section holder member to provide a releasable lock action to hold the light projection bulb in an activated state.

* * * * *